US007318735B2

(12) United States Patent
Fannin et al.

(10) Patent No.: US 7,318,735 B2
(45) Date of Patent: Jan. 15, 2008

(54) STANDOFF HEATER HOUSING

(75) Inventors: Jackie G. Fannin, Brookshire, TX (US); Jack L. McClanahan, Montgomery, TX (US)

(73) Assignee: Gaumer Company, Inc., Houston, TX (US)

( * ) Notice: Subject to any disclaimer, the term of this patent is extended or adjusted under 35 U.S.C. 154(b) by 0 days.

(21) Appl. No.: 11/639,906

(22) Filed: Dec. 15, 2006

(65) Prior Publication Data

US 2007/0141919 A1 Jun. 21, 2007

Related U.S. Application Data

(60) Provisional application No. 60/751,184, filed on Dec. 16, 2005.

(51) Int. Cl.
*H01R 4/60* (2006.01)

(52) U.S. Cl. ..... 439/191

(58) Field of Classification Search ..... 439/710, 439/191, 193, 192, 194, 587, 722
See application file for complete search history.

(56) References Cited

U.S. PATENT DOCUMENTS 3,871,734 A * 3/1975 Murtland ..... 439/275
4,781,607 A * 11/1988 Rumbaugh ..... 439/191
4,895,528 A * 1/1990 Choiniere et al. ..... 439/191
5,070,940 A * 12/1991 Conner et al. ..... 166/65.1
5,577,925 A * 11/1996 Schnatzmeyer et al. .... 439/191
6,145,597 A * 11/2000 Kobylinski ..... 166/384
6,994,589 B2 * 2/2006 Schliese ..... 439/587
7,204,724 B2 * 4/2007 Holtz ..... 439/722

* cited by examiner

*Primary Examiner*—Michael C. Zarroli
*Assistant Examiner*—Phuongchi Nguyen
(74) *Attorney, Agent, or Firm*—Bracewell & Giuliani LLP

(57) ABSTRACT

A circulation heater has a tank with heater tubes located within. The heater tubes are mounted to a header plate, and each contains an electrical resistance heater wire. A standoff plate is mounted to an exterior side of the header plate. Standoff tubes are secured to the standoff plate, each of the standoff tubes registering with one of the heater elements and containing an electrical conductor. A standoff housing is mounted to the opposite ends of the standoff tubes. The electrical conductors in the standoff tubes extend into the standoff housing for connection to electrical power wiring. Detaching the standoff plate from the header plate allows the standoff housing, standoff plate and standoff tubes to be removed as a unit from the tank.

13 Claims, 2 Drawing Sheets

STANDOFF HEATER HOUSING

This application claims priority to provisional application 60/751,184, filed Dec. 16, 2005.

FIELD OF THE INVENTION

This invention relates in general to electrical wiring housings for process heat exchangers and in particular to a standoff heater housing.

BACKGROUND OF THE INVENTION

Electrical heaters are often used in petrochemical processing plants. Typically, the heater has a tank with an inlet and an outlet for the circulation of a fluid to be heated. Heater tubes are installed within the tank, each heater tube containing an electrical resistance wire within a powder insulation. Each heater tube has one or two ends that are welded to an exterior side of a header plate. The header plate bolts to the tank, and the exposed ends of the electrical resistance wires extend into a housing for connection to electrical power wiring. The housing may be a cylindrical wall that is welded to the header plate. The housing has an outer end with a removable closure plate.

If a heater tube becomes faulty and needs to be repaired or replaced, a worker normally removes the header plate and assembly of heater tubes from the tank. The worker removes the closure cap from the housing, which provides access to the welds holding the heater tubes to the header plate. Even if the particular tube to be removed is located in the center of an extensive bundle of tubes, the worker has access to its weld to the header plate. The worker can thus remove the particular heater tube by cutting and grinding away the weld.

Some heaters have standoff housings, which locate the housings a selected distance from the header plate. In one prior art type, conductor rods are welded or brazed to the pins of the electrical resistance wires to form extensions. An extension or standoff tube is placed over the conductor rod, and the lower end of the standoff tube is abutted against one of the heater tube ends and welded to the exterior side of the header plate. The standoff housing has a base plate with holes for each of the standoff tubes, and the housing is placed over the free ends of the standoff tubes. A worker welds each standoff tube to the interior side of the base of the standoff housing.

In another type, the heater tubes have lengths selected so that they protrude beyond the header plate for the standoff distance. An intermediate portion of each heater tube is welded to the header plate, and the end of each heater tube is welded to the base plate of the standoff housing.

In both types of standoff housing arrangements mentioned above, the initial assembly of heater tubes or standoff tubes can be made by working from the inside of the bundle outward. Removing a particular element after assembly can be a problem if such element is located within the central portion of a bundle of tubes. In the first type, the open ends of the heater tubes are not accessible because extension tubes have been abutted and welded to the header plate. The open ends of the extension tubes are accessible in the offset housing, but grinding away the weld of one of the extension tubes does not provide any access to the open end of the heater tube. Rather a worker may have to remove many heater elements not otherwise selected for replacement merely to provide access.

In the second type, although the heater tube open ends are accessible by removing the closure plate in the offset housing, the heater tubes are also welded to the header plate. That weld would not be accessible to a worker if the particular heater tube were located in a central area of the bundle.

SUMMARY OF THE INVENTION

The heater of this invention has a tank, a header plate and a plurality of heater tubes mounted to the header plate and extending into the tank. Each heater tube contains an electrical resistance heater wire. A standoff plate and a standoff housing are secured to each other with a plurality of standoff tubes. An electrical conductor rod is joined to an end of each of the heater wires at the header plate.

During assembly, a worker slides the standoff plate and the standoff tubes over the conductor rods, and secures the standoff plate to the header plate. The conductor rods have ends protruding into the standoff housing for connection to electrical power wires. Detaching the standoff plate from the header plate allows the standoff plate, standoff tubes and standoff housing to be removed as a unit while the conductor rods remain joined to the electrical resistance wires. The removal of this unit provides access to the welded ends of the heater tubes at the header plate for repair or replacement.

DETAILED DESCRIPTION OF THE INVENTION

Figure 1:
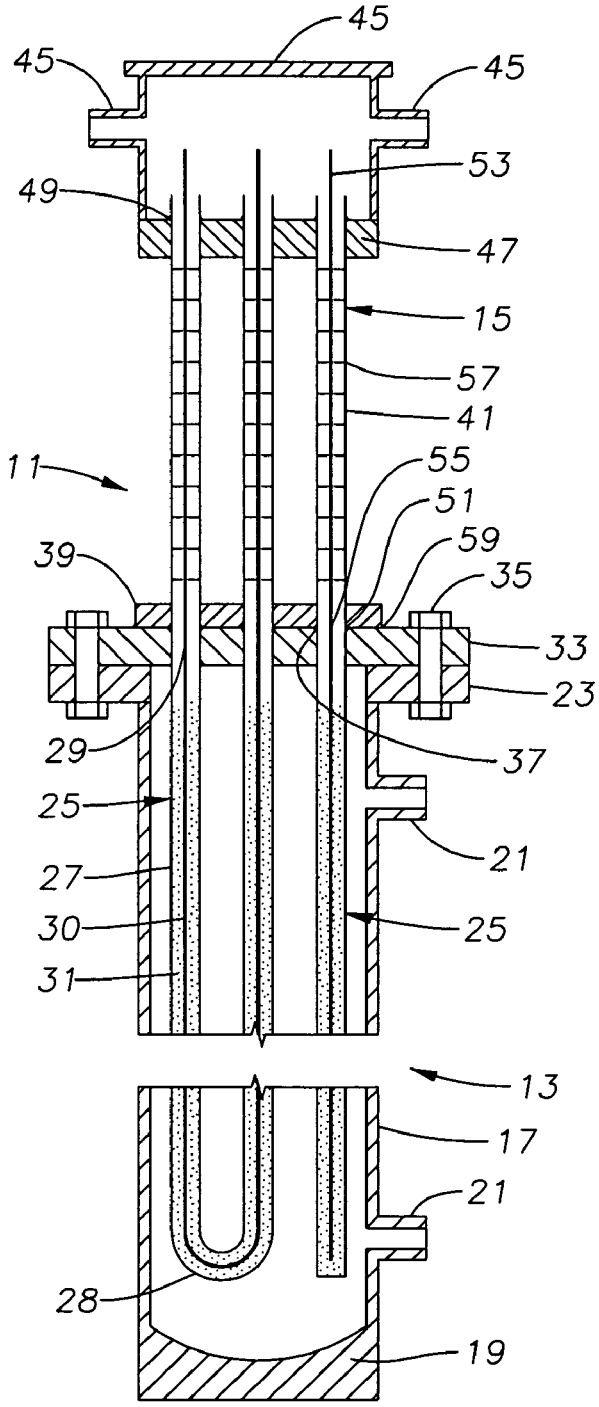
FIG. 1 is a schematic sectional view illustrating one type of process circulation heater constructed in accordance with this invention.

Referring to FIG. 1, circulation heater 11 is of the type used for heating fluids in processing plants, such as chemical plants. Heater 11 has a pressure vessel 13 and a standoff assembly 15. Pressure vessel 13 has a tank 17 that is generally cylindrical. Thermal insulation 19 is typically located on the exterior of tank 17. Tank 17 has ports 21 on its sidewall near opposite ends for circulating a fluid through tank 17. One end of tank 17 is closed and the other has an opening encircled by a flange 23. Circulation heater 11 is shown as an example only, and could be of other types, such as a flanged heater or screw plug heater.

A number of electrical resistance heater elements 25 are located within tank 17. In FIG. 1, only two of the heater elements 25 are shown, but normally a greater number of heater elements 25 would be utilized. Each heater element 25 comprises a metal tube 27 bent to form a U-shaped bend 28 and two open ends 29. Although not shown, some heater elements are straight, rather than U-shaped, and have open ends on opposite ends. A resistive heating wire 30 runs within metal tube 27 and extends from each open end 29 of each heater element 25. A typical material for resistive heating wire 30 is a nickel chromium alloy. Insulation powder 31 is preferably magnesium oxide, and is packed tightly within metal tube 27 around resistive heating wire 30. Header plate 33 is bolted to flange 23 of tank 17 by bolts 35. Open ends 29 extend through mating holes provided in the header plate 33. Typically, each open end 29 of metal tube 27 is brazed or welded to header plate 33 at metal tube welds 37.

Standoff assembly 15 comprises a standoff plate 39, a plurality of standoff tubes 41, and a cylindrical housing 43. Cylindrical housing 43 has ports 45 for wires (not shown) and a cylindrical housing base 47. Standoff tubes 41 are brazed or welded to cylindrical housing base 47 at cylindrical housing base welds 49, and to standoff plate 39 at standoff plate welds 51. Standoff electrical conductor rods 53 run within and extend from the top of standoff tubes 41. Each standoff electrical conductor 53 is welded, brazed or otherwise joined to one of the resistive heating wires 30 at conductor welds 55. Insulating washers 57 are inserted within standoff tubes 41 and insulate standoff electrical conductors 53 from standoff tubes 41. Standoff plate 39 is welded or brazed to header plate 33 at header plate weld 59, which runs about the circumference of standoff plate 39. Header plate weld 59 is preferably a 45-degree beveled weld. Rather then welding standoff plate 39 to header plate 33, bolts could be employed.

Figure 2:
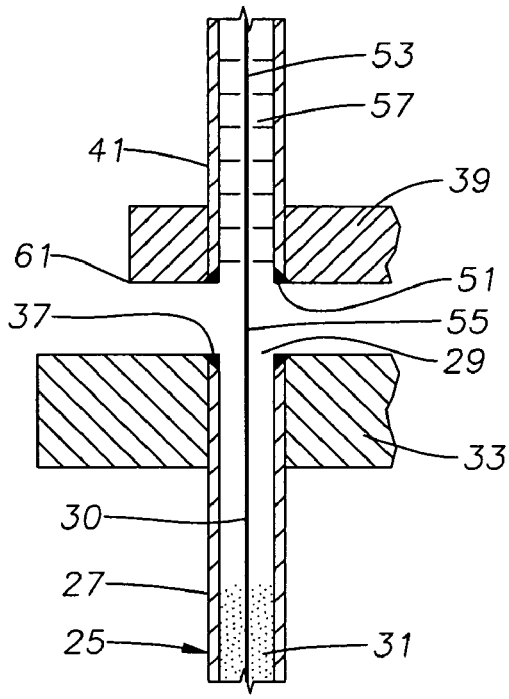
FIG. 2 is an enlarged sectional view of the standoff plate and header plate of FIG. 1, wherein the standoff plate and header plate are separated.

FIG. 2 is an enlarged sectional view of standoff plate 39 and header plate 33 of FIG. 1, wherein standoff plate 39 and header plate 33 are shown separated. Standoff tube 41 is brazed or welded to standoff plate 39 at standoff plate weld 51. Standoff plate weld 51 is preferably a 45-degree beveled weld. Metal tube 27 is brazed or welded to header plate 33 at metal tube weld 37. Metal tube weld 37 is preferably a 45-degree beveled weld. Point 61 indicates where header plate weld 59 of FIG. 1 would join standoff plate 39 and header plate 33 were those plates not separated.

Figure 3:
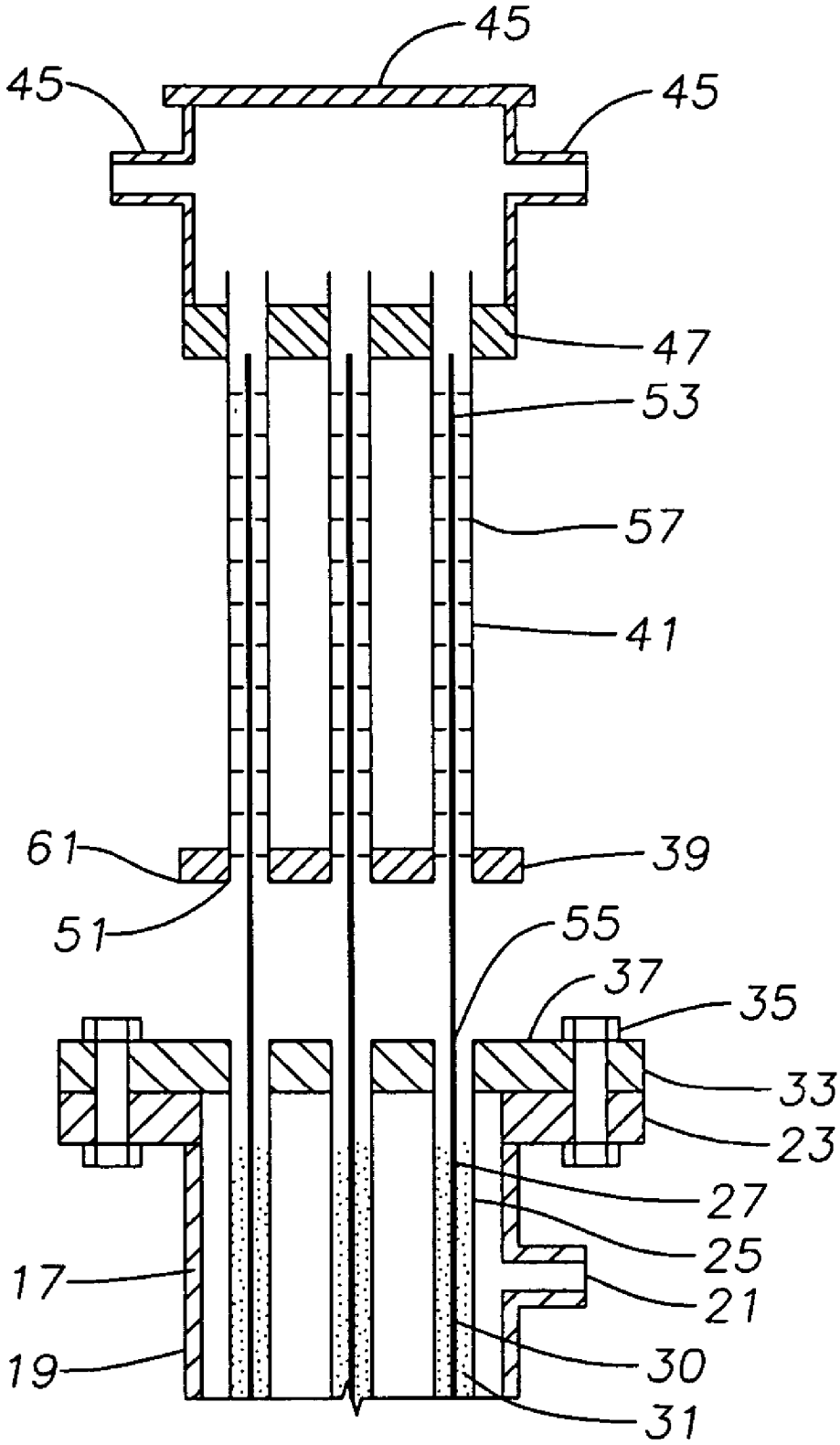
FIG. 3 is a sectional view of the standoff heater housing, header plate, and the upper portion of the pressure vessel of FIG. 1, wherein the standoff heater housing and header plate are separated, and the standoff heater housing is lifted.

FIG. 3 is a sectional view of standoff assembly 15, header plate 33, and the upper portion of pressure vessel 13 of FIG. 1, wherein standoff assembly 15 and header plate 33 are shown separated, and standoff assembly 15 is lifted.

During manufacturing of circulation heater 11, after standoff assembly 15 has been assembled, standoff plate 39 is placed in flush contact with header plate 33 and welded to header plate 33 at header plate weld 59. Header plate 33 is in turn bolted to flange 23 of tank 17 by bolts arranged in a circular pattern. Standoff plate 39 has a smaller diameter than the circular bolt pattern so that it can fit within the diameter circumscribed by the bolt pattern.

During maintenance of circulation heater 11, bolts 35 are removed, permitting removal of standoff assembly 15, header plate 33, and electrical resistance heater elements 25 as a single unit. Header plate weld 59 is cut to permit the removal of standoff assembly 15 as a unit from header plate 33. Conductor rods 53 remain joined to the pins of electrical resistance wires 30. Once removed, the worker has access to open ends 29 and welds 37 of electrical resistance heater elements 25. The worker also has access to conductor welds 55 of standoff electrical conductors 53. The worker can then remove one or more heater elements 25 from header plate 33 by cutting or grinding welds 37. If necessary, the worker may need to cut some of the conductor rods 53 from electrical resistance wires 30 to achieve access to the desired weld 37.

The invention has significant advantages. The removable standoff plate allows ready access to the welds of the heater tubes to the header plate. This arrangement allows a worker to more easily replace a heater tube located within a central portion of the bundle of heater tubes. The cost of repair is reduced considerably for standoff housing type heaters.

While the invention has been shown in only one of its forms, it should be apparent to those skilled in the art that it is not so limited but is susceptible to various changes without departing from the scope of the invention.

The invention claimed is:

1. A heater, comprising:

a tank;

a header plate mounted to one end of the tank, the header plate having a plurality of holes therethrough;

a plurality of heater tubes mounted to the header plate and extending into the tank, each heater tube having at least one open end in registry with one of the holes, each heater tube containing an electrical resistance heater wire surrounded by electrical insulation;

a standoff plate mounted to an exterior side of the header plate, the standoff plate having a plurality of holes, each of which registers with one of the holes in the header plate;

a plurality of standoff tubes, each of the standoff tubes having an end secured to the standoff plate, each of the standoff tubes registering with one of the holes in the header plate;

an electrical conductor within each of the standoff tubes, each electrical conductor being electrically connected to one of the heater wires;

a standoff housing having a base containing a plurality of holes, each of the standoff tubes having another end mounted to the base of the standoff housing in registry with one of the holes in the base of the standoff housing, the electrical conductors in the standoff tubes extending through the holes in the base of the standoff housing for connection to electrical power wiring; and wherein detaching the standoff plate from the header plate allows the standoff housing, standoff plate and standoff tubes to be removed as a unit from the tank.

2. The heater according to claim 1, wherein the electrical conductors in the standoff tube are secured to the heater wires so as to remain secured to the heater wires while the standoff plate, standoff tubes and standoff housing are removed from the tank.

3. The heater according to claim 2, further comprising:

a tubular electrical insulation member inserted between each conductor and its surrounding standoff tube, each insulation member being in nonbonding contact with one of the conductors.

4. The heater according to claim 1, wherein the standoff plate is welded to the header plate.

5. The heater according to claim 1, wherein each standoff tube extends into one of the holes in the standoff plate and is welded to an interior side of the standoff plate.

6. The heater according to claim 1, wherein each heater tube extends into one of the holes in the header plate and is welded to the header plate by a weld on an exterior side of the header plate.

7. The heater according to claim 1, wherein each electrical resistance heater wire has a pin on its end that extends through one of the holes in the header plate, and each of the conductors is welded to one of the pins.

8. The heater according to claim 1, wherein:

the tank has an external circular flange;

the header plate is bolted to the flange with a circular array of bolts; and the standoff plate is circular and has a smaller diameter than the circular array of bolts so as to fit in flush contact with the header plate within the circular array.

9. A heater, comprising:

a tank;

a header plate mounted to one end of the tank, the header plate having a plurality of holes therethrough;

a plurality of heater tubes having open ends welded to the header plate and extending into the tank, each heater tube having at least one open end in registry with one of the holes, each heater tube containing an electrical resistance heater wire surrounded by electrical insulation;

a plurality of electrical conductor rods, each having a first end joined to one of the heater wires and extending outward from the header plate;

a standoff plate having an inner side mounted flush to an exterior side of the header plate, the standoff plate having a plurality of holes, each of which registers with one of the holes in the header plate a plurality of standoff tubes, each of the standoff tubes having a first end welded to the standoff plate, each of the standoff tubes registering with one of the holes in the header plate;

a standoff housing having a base containing a plurality of holes, each of the standoff tubes having a second end welded to the base of the standoff housing in registry with one of the holes in the base of the standoff housing;

the conductor rods extending through the standoff tubes and the base of the standoff housing and having second ends in the standoff housing for connection to electrical power wiring; and wherein detaching the standoff plate from the header plate allows the standoff housing, standoff plate and standoff tubes to be removed as a unit from the tank while the conductor rods remain joined to the electrical resistance wires.

10. The heater according to claim 9, further comprising an electrical insulation member releasably inserted into each of the standoff tubes, each of the insulation members having a passage for sliding over one of the conductor rods.

11. The heater according to claim 9, wherein a weld at a perimeter of the standoff plate secures the standoff plate to the header plate.

12. The heater according to claim 9, wherein:

the tank has an external circular flange;

the header plate is bolted to the flange with bolts in a circular bolt pattern; and the standoff plate is circular and has a smaller diameter than the bolt pattern so as to fit within the bolt pattern.

13. The heater according to claim 9, wherein the first end of each of the standoff tubes is welded to the inner side of the standoff plate.

* * * * *